US005740953A

United States Patent [19]

Smith et al.

[11] Patent Number: 5,740,953

[45] Date of Patent: Apr. 21, 1998

[54] METHOD AND APPARATUS FOR CLEAVING SEMICONDUCTOR WAFERS

[75] Inventors: Colin Smith; Kalman Kaufman; Isaac Mazor; Elik Chen; Dan Vilenski, all of Haifa, Israel

[73] Assignee: Sela Semiconductor Engineering Laboratories, Israel

[21] Appl. No.: 193,188

[22] PCT Filed: Aug. 14, 1992

[86] PCT No.: PCT/EP92/01867

§ 371 Date: May 17, 1994

§ 102(e) Date: May 17, 1994

[87] PCT Pub. No.: WO93/04497

PCT Pub. Date: Mar. 4, 1993

[30] Foreign Application Priority Data

Aug. 14, 1991 [IL] Israel ..... 99191
Jul. 22, 1992 [IL] Israel ..... 102595

[51] Int. Cl.[6] ..... B26F 3/00

[52] U.S. Cl. ..... 225/2; 225/1

[58] Field of Search ..... 225/103, 104, 225/105, 96.5, 2; 125/23.01; 83/881

[56] References Cited

U.S. PATENT DOCUMENTS

| | | | |
|---|---|---|---|
| 3,230,625 | 1/1966 | Meyer | 125/23.01 X |
| 3,247,576 | 4/1966 | Dill, Jr. et al. | 125/23.01 X |
| 3,384,279 | 5/1968 | Grechus . | |
| 3,494,521 | 2/1970 | Hellstrom | 225/104 X |
| 3,572,564 | 3/1971 | Fleming | 225/2 |
| 3,680,213 | 8/1972 | Reichert . | |
| 3,756,482 | 9/1973 | De Torre | 225/2 |
| 3,790,051 | 2/1974 | Moore | 225/93 |
| 3,901,423 | 8/1975 | Hillberry et al. | 125/23.01 X |
| 3,920,168 | 11/1975 | Regan et al. | 225/103 |
| 4,049,167 | 9/1977 | Guissard | 225/2 |
| 4,216,004 | 8/1980 | Brehm et al. | 225/96.5 |
| 4,228,937 | 10/1980 | Tocci | 225/2 |
| 4,244,348 | 1/1981 | Wilkes | 225/2 |
| 4,498,451 | 2/1985 | Beltz et al. | 125/23.01 |
| 4,647,300 | 3/1987 | Sheets | 225/96.5 |
| 4,653,680 | 3/1987 | Regan . | |
| 4,693,403 | 9/1987 | Sprouse | 225/2 |
| 4,775,085 | 10/1988 | Ishizuka . | |
| 4,955,357 | 9/1990 | Takeguchi et al. | 225/103 X |
| 5,133,491 | 7/1992 | Correll et al. | 225/103 X |
| 5,327,625 | 7/1994 | Clark, Jr. et al. | 125/23.01 X |
| 5,381,713 | 1/1995 | Smith | 83/881 |
| 5,551,618 | 9/1996 | Shinozaki et al. | 225/93 |

*Primary Examiner*—Kenneth E. Peterson
*Attorney, Agent, or Firm*—Ladas & Parry

[57] ABSTRACT

A method and apparatus are described for cleaving a relatively thin semiconductor wafer for inspecting a target feature on a workface thereof by: producing, on a first lateral face of the semiconductor wafer, laterally of the workface on one side of the target feature, an indentation in alignment with the target feature; and inducing by impact, in a second lateral face of the semiconductor wafer, laterally of the workface on the opposite side of the target feature, a shock wave substantially in alignment with the target feature and the indentation on the first lateral face, to split the semiconductor wafer along a cleavage plane essentially coinciding with the target feature and the indentation.

10 Claims, 17 Drawing Sheets

METHOD AND APPARATUS FOR CLEAVING SEMICONDUCTOR WAFERS

FIELD AND BACKGROUND OF THE INVENTION

The present invention relates to a method and apparatus for cleaving semiconductor wafers. The invention is particularly useful for cleaving semiconductor wafers in order to inspect a cross-section of the wafer at a specified location, designated by a target feature or features (hereinafter a target feature) on a workface of the wafer, and the invention is therefore described below with respect to such an application.

A semiconductor wafer includes several thin layers of insulating and conducting materials deposited sequentially on the workface of a semiconductor substrate. The processes for depositing these materials are very complex and must be performed with a high degree of precision in order to minimize manufacturing faults which substantially lower yields. For this reason, the manufacturing processes include quality controls for cross-sectioning and inspecting selected target features on the workface of the wafer. For the inspection to be meaningful, the cross-sectioning of the wafer must essentially (within a few microns) coincide with the target feature.

Such cross-sectioning of a wafer is generally performed manually, by first producing a coarse cleavage with a tolerance of approximately 1 mm off the designated target feature, followed by manual grinding or the like in order to achieve the desired final tolerance in the micron range. Such manual cross-sectioning is extremely time consuming (usually requiring several working hours), inaccurate, and highly dependent on the proficiency of the operator.

In an attempt to overcome the above shortcomings of the manual cross-sectioning method, some mechanical methods have been proposed. Thus, in a paper entitled "Meeting the Challenge of Dicing and Fracturing Brittle III–V Materials" by Barry F. Regan and Glen B. Regan, of Dynatex Corporation, Redwood City, Calif., published November 1989 in "Microelectronic Manufacturing and Testing", it was suggested to scribe a line on the upper workface of a wafer, and subsequently to induce a shock that propagates within the wafer essentially normal to the scribed surface, e.g., by impacting the opposite wafer face. Such a method, however, would not be suitable for cleaving a wafer for inspecting a target feature on the workface during quality control of manufacturing processes performed on the wafer. Thus, such a scribed line applied across the workface of the wafer could preclude the target feature from being inspected in the form it comes out of the manufacturing process as required by quality control. Moreover, such a scribed line crossing the entire upper, workface of the wafer would hardly ever exactly coincide with a natural cleavage plane, so that a jagged fracture would generally be produced, which is undesirable for qualtity control inspection. A similar semi-mechanical method for fracturing wafers in order to produce dies in cubic form is described in U.S. Pat. No. 4,653,680, but such a method would also have the above-described drawbacks when used for cleaving a relatively thin semi-conductor in order to permit inspecting a target feature on a relatively large-area workface of the wafer.

It would therefore be highly desirable to provide an improved method and apparatus for cleaving a relatively thin semiconductor wafer in order to permit inspecting a target feature on a relatively large-area workface of the wafer for quality control purposes.

BRIEF SUMMARY OF THE INVENTION

According to one aspect of the present invention, there is provided a method of cleaving a relatively thin article for inspecting a target feature on a large-area workface thereof circumscribed by small-area lateral faces defining the thickness of the article, comprising the steps:

(a) producing an indentation in a first small-area lateral face of the article on one side of the target feature;

(b) and inducing, in a second, small area lateral face of the article, on an opposite side thereof with respect to the target feature, a shock wave in alignment with the target feature and the indentation on the first lateral face, to split the article along a cleavage plane coinciding with the target feature and the indentation.

According to further featurers in the described preferred embodiment, the article is stressed in tension by gripping means gripping the wafer on opposite sides of the cleavage plane at the time the shock wave is induced; also, the shock wave is induced by impacting the second lateral face of the semiconductor wafer.

According to still further features in the preferred embodiment of the invention described below the article is a semiconductor wafer, and, before steps (a) and (b), a coarse cleaving operation is performed on a larger segment of the semiconductor wafer to produce a smaller segment of the semiconductor wafer containing the target feature.

According to still further features in the described preferred embodiment, the indentation in the fine cleaving operation is produced by a scribing member moved along the first lateral face of the semiconductor wafer to scribe a line extending substantially perpendicularly to the workface of the semiconductor wafer. As a rule, the scribed line should extend over the entire thickness of the lateral face, but there may be cases (e.g., where the latter face has an undulating contour) where the scribed line extends over only part of the lateral face thickness, but that part should be at least half the thickness.

Such a technique has been found capable of cleaving wafers having a width of 10–15 mm, a length of 40–100 mm, and a thickness of a fraction of a millimeter (e.g., 0.5 mm) with an accuracy in the micron range (usually less than 3 microns and on the average of 1–2 microns) of the target feature, suitable for the above-described quality control purposes. Moreover, the cleaving operations can be performed in a matter of minutes (as compared to hours in the manual method), and with less skilled personnel than in the manual method.

The invention also provides apparatus for cleaving semiconductor wafers or similar articles in accordance with the above method.

Further features and advantages of the invention will be apparent from the description below.

BRIEF DESCRIPTION OF THE DRAWINGS

The invention is herein described, by way of example only, with reference to the accompanying drawings, wherein.

Figure 6:
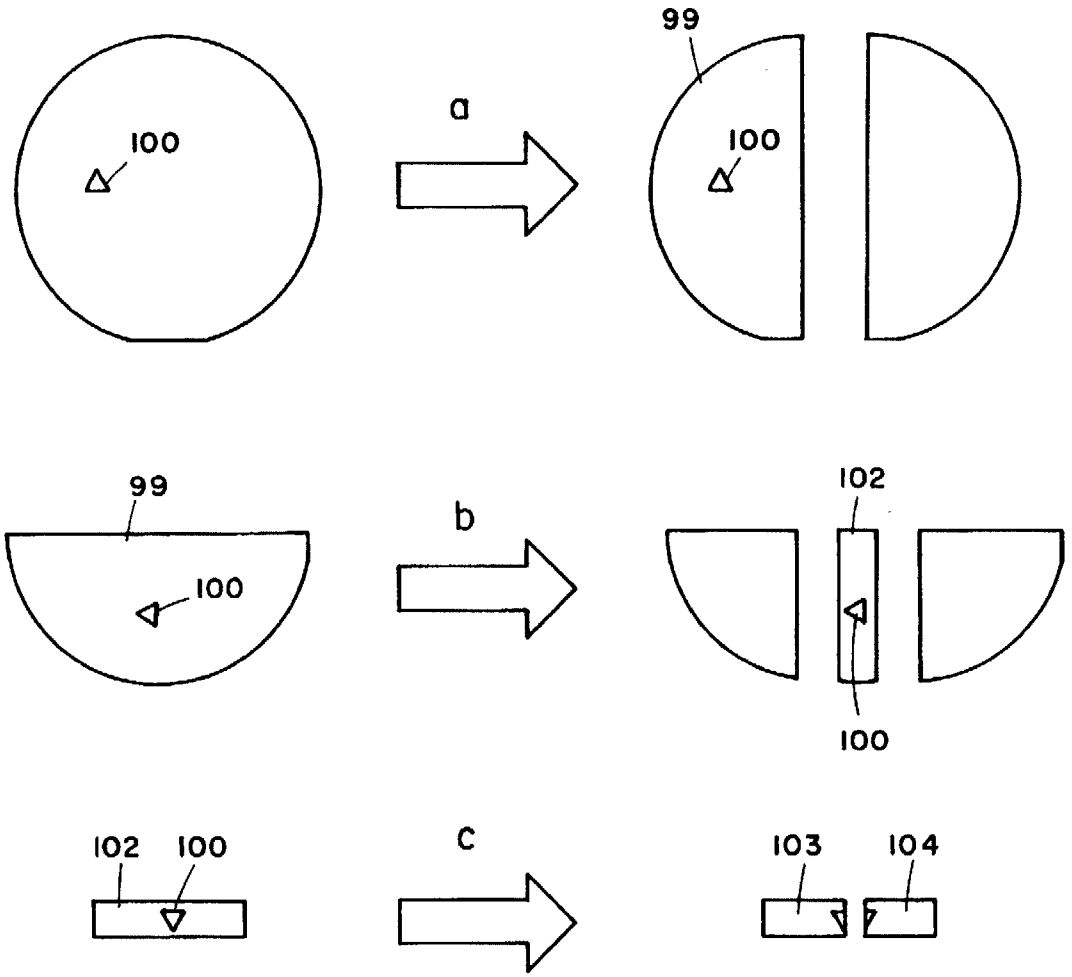
FIGS. 6*a*–6*c* diagrammatically illustrate the wafer cleaving operations.

FIGS. *7a–7i* are diagrammatic plan views showing nine successive stages for performing the cleaving operations of FIGS. 6*b* and 6*c;*

Figure 8:
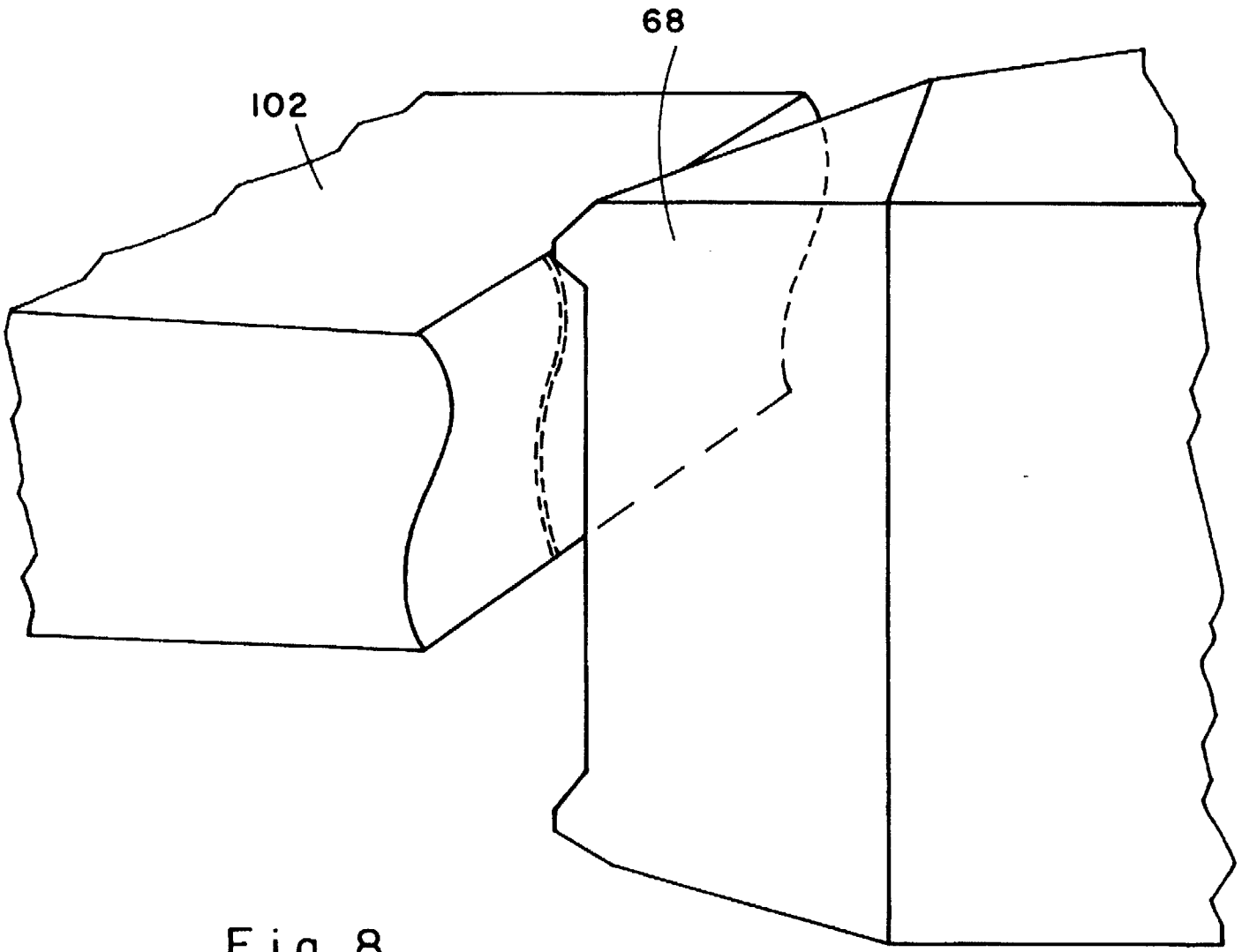
Figure 9:
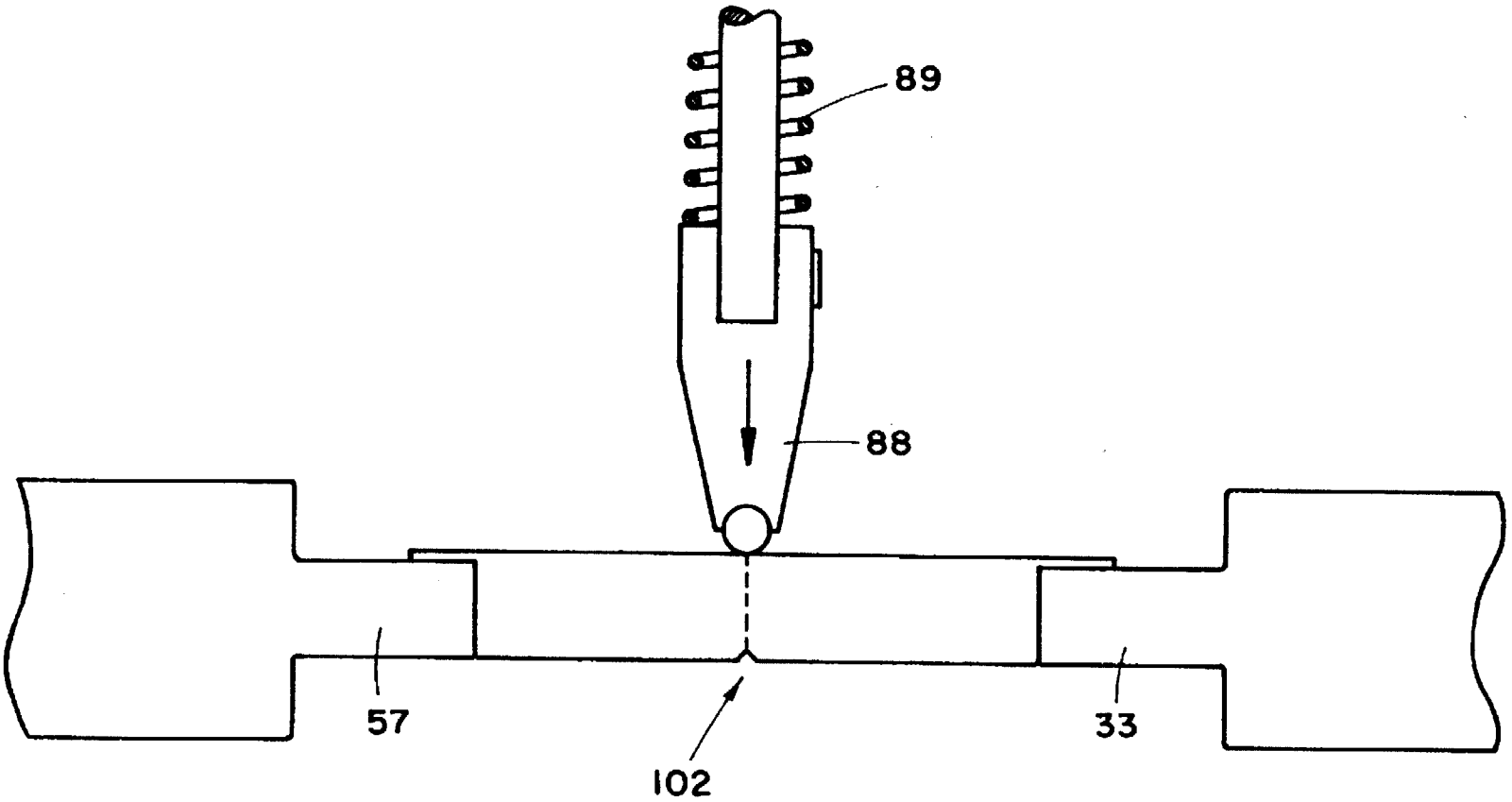

FIG. 8 is a diagrammatic axonometric representation showing the scribing operation on a lateral face of a wafer segment; and FIG. 9 is a diagrammatic illustration of the hammer striking phase during fine cleavage.

In the following description, the direction parallel to the horizontal axis in FIG. 1 (i.e., the length of the illustrated apparatus) will be referred to as the X-direction; the direction parallel to the horizontal axis in FIG. 2 (i.e., the width of the illustrated apparatus) will be referred to as the Y-direction, and the direction parallel to the vertical axis in FIGS. 1 and 2 (i.e., the height of the apparatus) will be referred to as the Z-direction.

Figure 1:
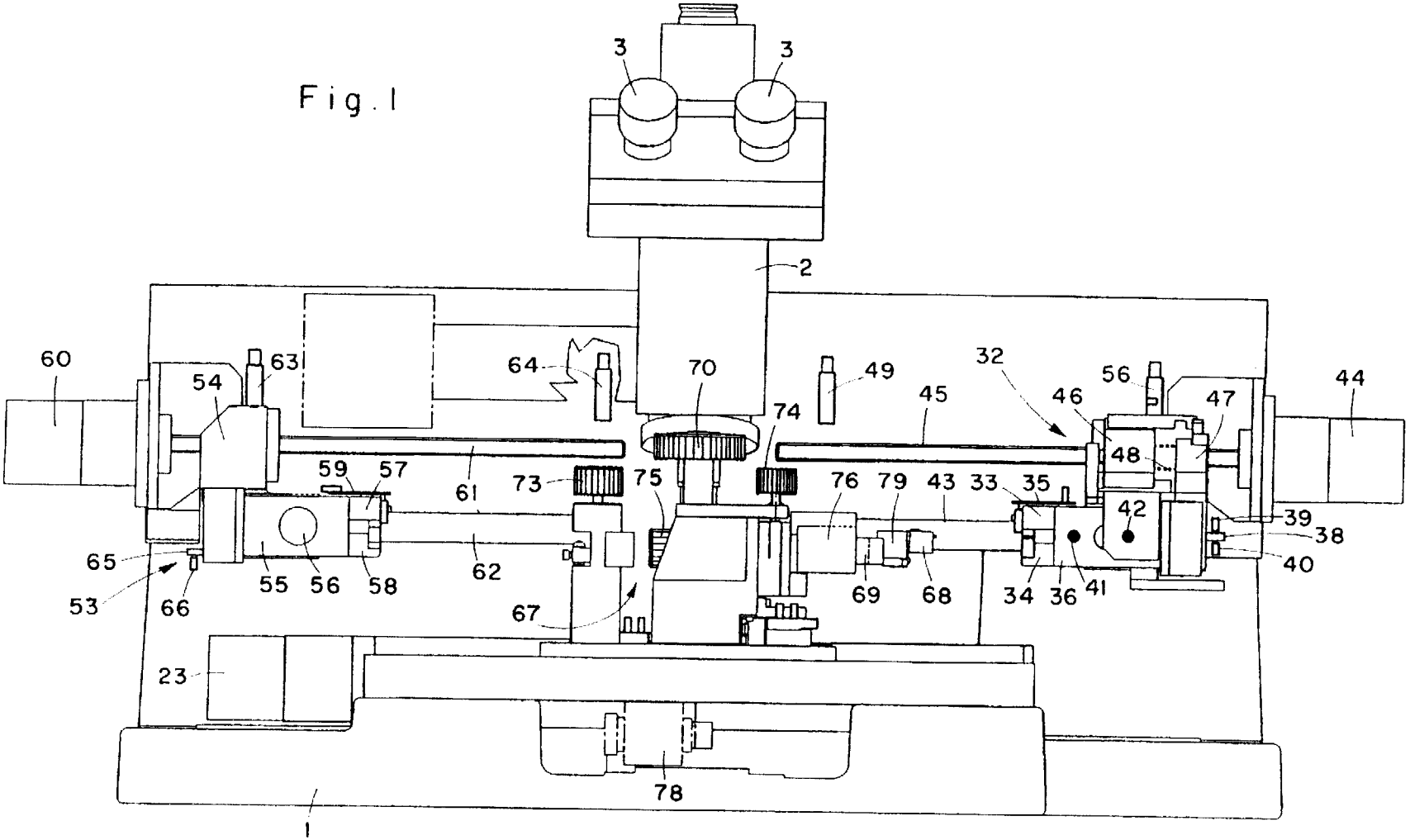
FIGS. 1 and 2 are front and side elevations of one form of apparatus according to the invention.
Figure 2:
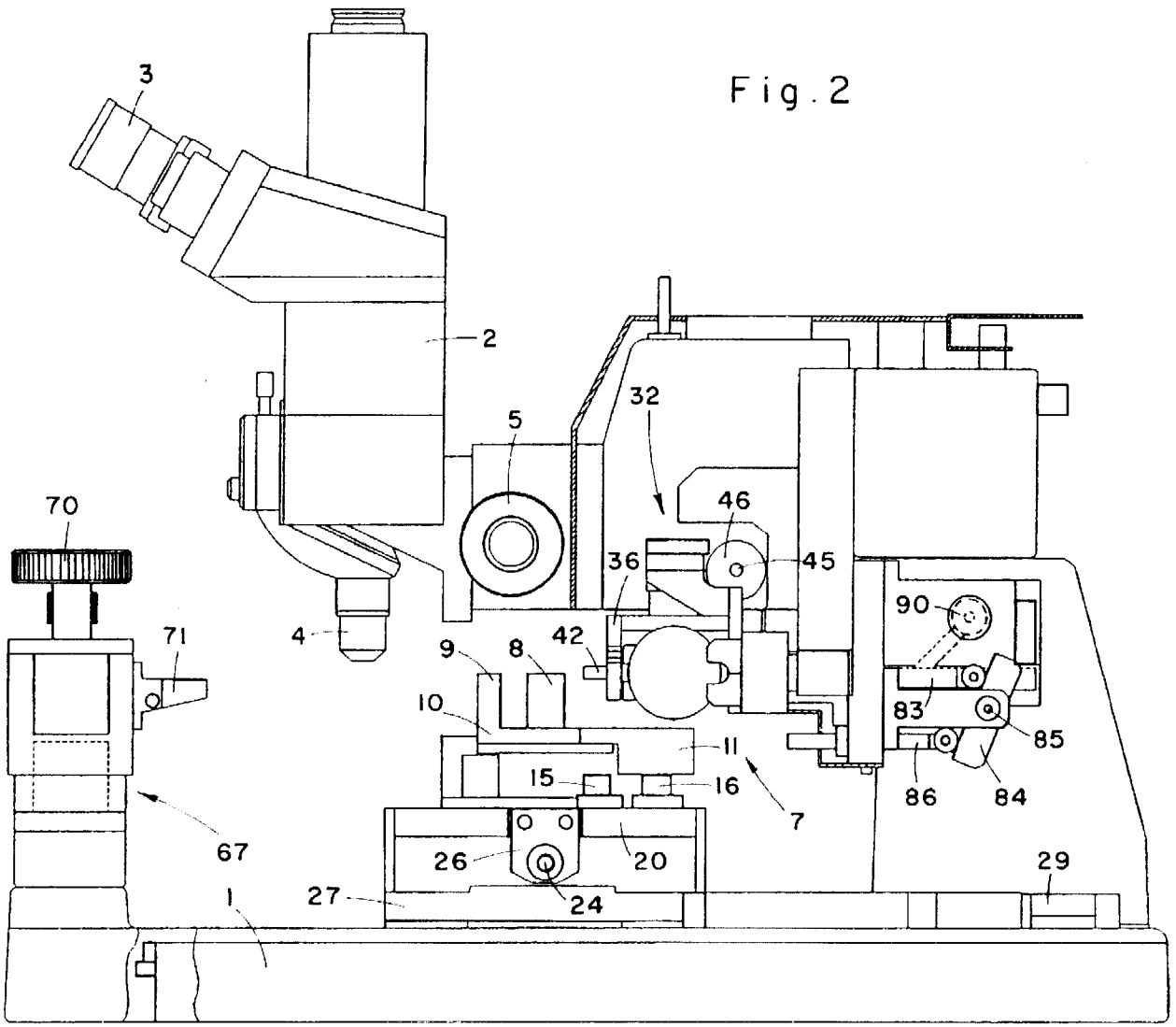

The apparatus shown in FIGS. 1–5 comprises a base 1 and a microscope 2 fitted with two eyepieces 3 and several objectives 4, only one of which is shown (FIG. 2). Microscope 2 further comprises a focusing knob 5 and a light source 6.

The illustrated apparatus further includes first holding means in the form of a vacuum chuck assembly 7 comprising a vacuum chuck 8 and a column 9. Vacuum chuck 8 and column 9 together support a wafer segment or segment that is being processed preparatory to quality control inspection. Chuck 8 and column 9 project from a base plate 10 which has an extension 11 and which is mounted on a rotatable gear 12 (FIG. 4) engaged by a worm gear 13 linked to an electric step motor 14 (FIG. 5) via suitable transmission means. By the action of step motor 14, gear wheel 12 can be rotated clockwise or counter-clockwise, as may be required. The angular movement is restricted to about 90° by engagement of extension 11 with two limit switches 15 and 16 (FIG. 2).

Gear wheel 12 is mounted on a plate 20 and is movable in the X-direction (i.e., lengthwise of the apparatus) on a pair of tracks via ball bearings 22 by the action of an electric step motor 23. The motor has a screw-threaded shaft 24 engaging an internally screw-threaded sleeve (not shown) integral with plate 20. The end portion of shaft 24 is rotatably held in a lug 26 of the vacuum chuck assembly. Limit switches (not shown) are provided for limit the movement of the vacuum chuck unit 7 within a fixed stretch of tracks 21.

Vacuum chuck assembly 7 comprises another plate 27 which is slidably mounted on a pair of tracks 28 (FIG. 3) so as to be movable in the Y-direction (i.e., widthwise of the apparatus). This movement is brought about by an electric step motor, shown schematically at 29, e.g., by a screw-threaded shaft engaging an internally screw-threaded sleeve integral with plate 27. Limit switches may also be provided, similar to the case of plate 20, for limiting the movement of the vacuum chuck assembly 7 within a fixed stretch of tracks 28. The X-Y movements of the vacuum chuck assembly 7 are thus brought about by a dual assembly with the X-stage mounted atop of the Y-stage.

On the right hand side (with reference to FIG. 1), the apparatus includes a first gripper assembly 32 with upper and lower jaws 33 and 34 fitted with electronic sensor means, shown schematically at 35 in FIG. 1, which produces a signal when a wafer segment penetrates between the jaws. This signal is routed to the computer and triggers an associated solenoid (not shown) by which the lower jaw 34 is reciprocated between a lower releasing position and an upper gripping position. Jaws 33 and 34 are held by a block 36 which has two degrees of freedom, one for tilting about a horizontal axis extending in the Y-direction (i.e., widthwise of the apparatus), and the other for raising and lowering in the Z-direction (i.e., heightwise of the illustrated apparatus). In this way the jaws 33 and 34 are adequately adjustable relative to a wafer segment brought to the jaws by means of the vacuum chuck assembly 7.

The first gripper assembly 32 includes a rear bracket 38 (FIG. 1) associated with two reciprocating pneumatic mini-plungers 39 and 40 which are capable of reciprocating blocks 36 and thereby also the jaws 33, 34. Assembly 32 further comprises two side locating pins 41 and 42 which serve for initial placement and alignment of a wafer segment.

The first gripper assembly 32 is mounted on a rail 43 and includes an electric motor 44 (see particularly FIG. 5) having a screw-threaded motor shaft 45 engaged by an internally screw-threaded nut 46 linked to a rear upright member 47 projecting from block 36 by means of a helical spring 48. The arrangement is such that when the electric motor 44 rotates, nut 46 moves from left to right, or right to left (FIGS. 1, 5), depending on the direction of rotation. When motor 44 is operating, helical spring 48 transmits in a damped fashion to block 36 the movement of nut 46 via upright member 47. A pair of limit switches 49 and 50 ensure that the movement of the assembly 32 on rail 43 remains confined within a set stretch.

On the left hand side (with reference to FIG. 1), the apparatus includes a second gripper assembly 53 which is of simpler design than the first gripper assembly 32. Gripper assembly 53 includes a block member 54 holding an arm 55 swingable about a horizontal axis 56 which extends in the Y-direction (i.e., widthwise of the illustrated apparatus) and which carries upper and lower jaws 57 and 58. These jaws are fitted with electronic sensor means, shown schematically in FIG. 1 at 59, which produces a signal when a wafer segment is fed between them. This signal is routed to the computer and triggers an associaed solenoid to reciprocate the lower jaw 58 between a lower releasing position and an upper gripping position, similar to jaw 34 of the first gripper assembly 32.

Gripper assembly 53, as shown particularly in FIG. 1, is associated with an electric motor 60 having a screw-threaded motor shaft 61 extending through a screw-threaded bore in block 54 whereby the assembly 53 is movable from left to right or right to left (FIG. 1) on a rail 62, depending on the direction of rotation of motor 60. Limit switches 63 and 64 function similarly to switches 49 and 50 of the first gripper assembly 32. Arm 55 has a rear bracket 65 for actuation by a mini-plunger 66 whereby the arm may be levelled from an inclined to a fully horizontal position.

The illustrated apparatus further includes an assembly 67 carrying a fine diamond indenter 68 mounted on a foldable arm 69. Arm 69 is swingable between an inoperative position shown in FIGS. 1 and 3 in which the arm 69 extends in the X-direction (i.e., lengthwise of the illustrated apparatus), and an operative position (not shown in FIGS. 1–3) in which the arm 69 is turned by 90° and extends in the Y-direction (i.e., widthwise of the apparatus). The folding and unfolding of arm 69 is carried out manually by means of a knob 70 fitted with a bracket 71 which, by cooperation with a stop 72 (FIG. 3), limits the rotation of arm 69 exactly to 90°.

Knob 73 adjusts indenter 68 in the X-direction; knob 74 adjusts it in the Y-direction; and knob 75 adjusts it in the Z-direction.

Arm 69 carries a transmission box 76 which transmits the fine adjustments in the Y and Z-directions whether done manually, by means of knobs 74 and 75, or mechanically by a step motor 78 (FIG. 1). For performing the actual scribing operation, indenter 68 is moved in the Z-direction by means of step motor 78 via transmission box 76.

Arm 69 further carries a load cell 79. This cell forms part of a strain gauge pressure sensor that serves, via the computer, as a closed loop control whereby a uniform depth of the scribing line is ensured.

The apparatus shown in FIGS. 1–5 further has a coarse cleavage assembly including a coarse diamond indenter 82 (see FIG. 3) exending in the Y-direction (i.e., widthwise of the apparatus). Indenter 82 is operable by a pushbar 83 which is actuated by a second pushbar 86 via a lever 84 pivotally mounted at 85 such that movement of pushbar 86 in one direction moves pushbar 83 in the opposite direction. Pushbar 86 is pushed from left to right (with reference to FIG. 2) when the vacuum chuck assembly 7 is moved in the Y-direction (i.e., also from left to right widthwise of the apparatus) to cause its extension 11 to engage and actuate the left hand end of pushbar 86. Upon such actuation, the coarse indenter 82 is pushed forward, i.e., from right to left. The coarse indenter assemby also includes spring means (not shown) whereby at the end of an operation cycle the coarse indenter 82 is retracted into the inoperative starting position shown in FIG. 3.

A hammer 88 (FIG. 3) loaded with a spring 89 (FIG. 9) and operable by means of a mechanism 90 (FIG. 2) is mounted close to the coarse indenter 82 and extends in parallel thereto. Mechanism 90 includes solenoid means for releasing the hammer, and cocking means for retracting it back to the non-operational starting position shown in FIG. 3.

Figure 3:
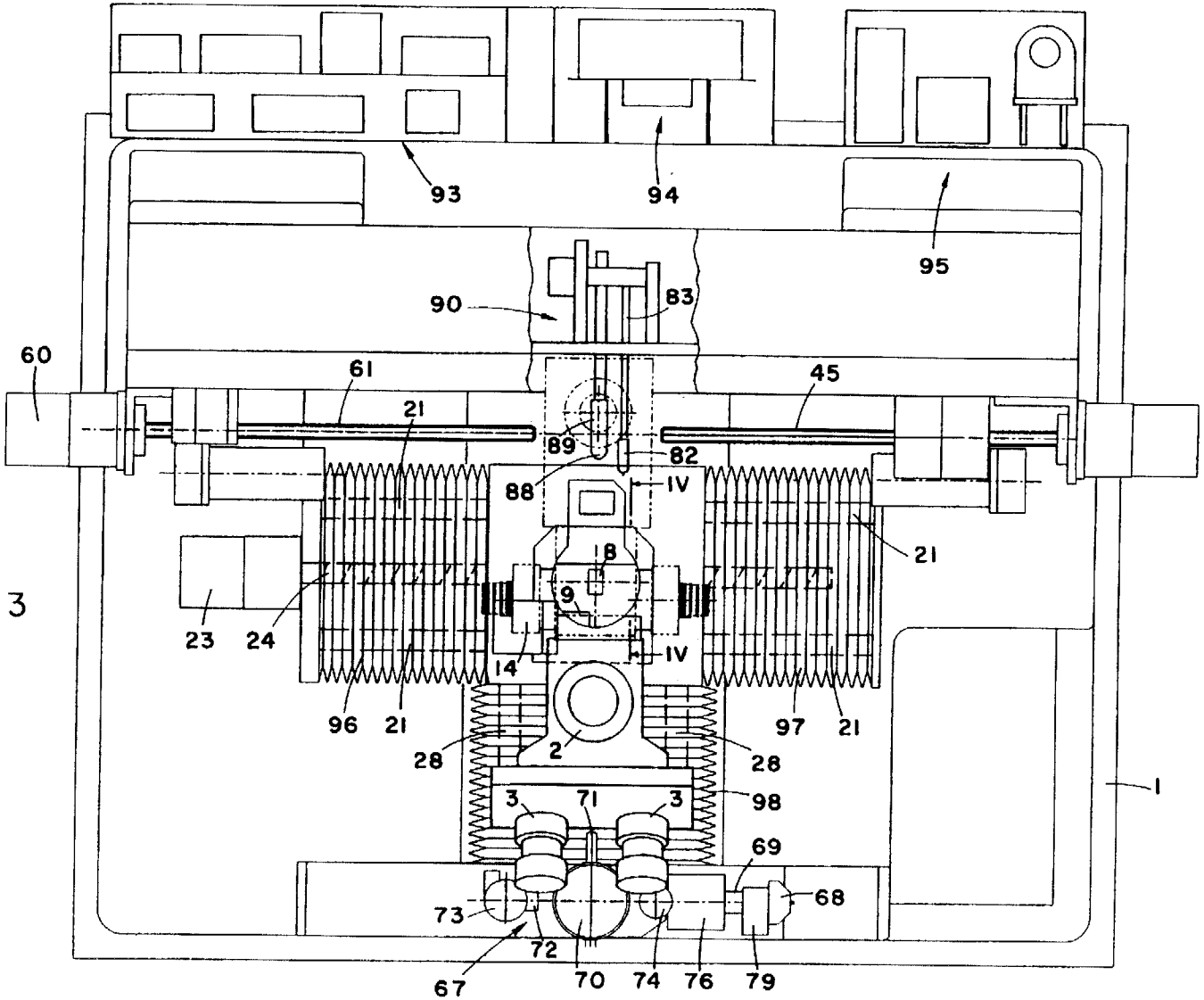
FIG. 3 is a plan view of the apparatus of FIGS. 1 and 2.
Figure 4:
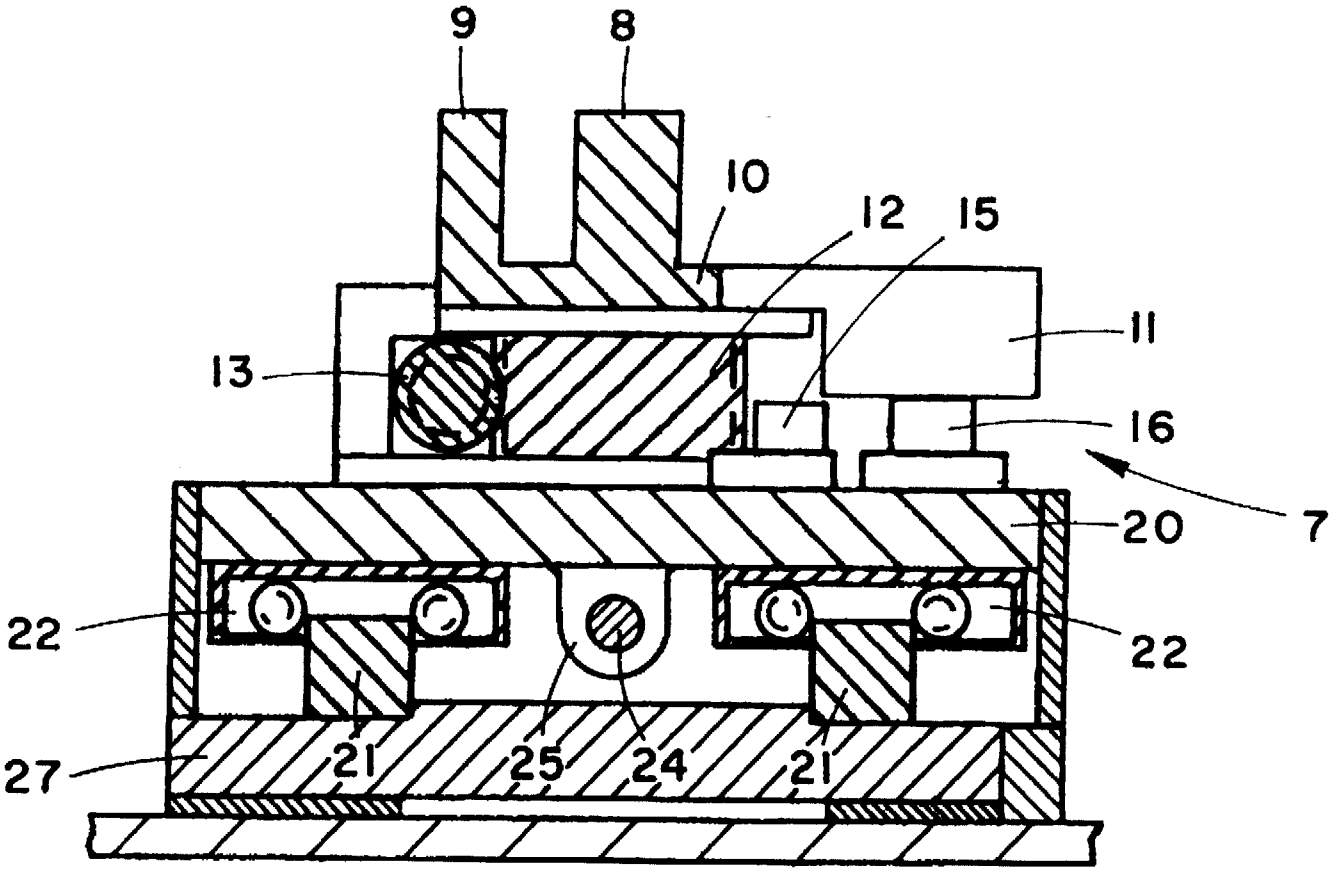
FIG. 4 is an enlarged section of the vacuum chuck asembly taken along line IV—IV in FIG. 3.
Figure 5:
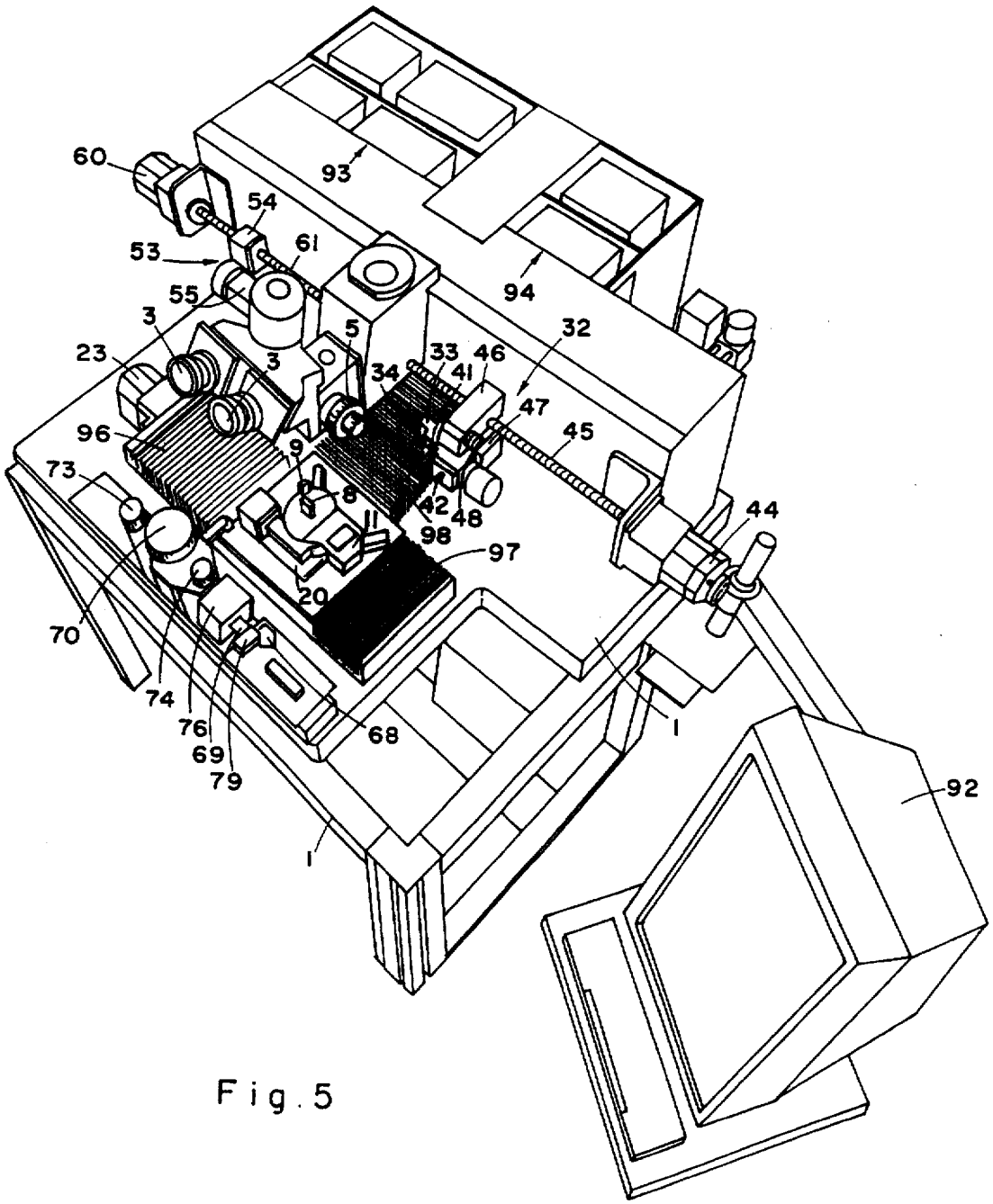
FIG. 5 is an axonometric view of part of the apparatus of FIGS. 1–4.

A suitably programmed PC-type computer 92 (FIG. 5) is associated with the illustrated apparatus for the keyboard-triggered and automatic control of the various functions thereof, via a plurality of hardware cards mounted to the rear of the apparatus as indicated at 93, 94 and 95 in FIG. 3.

As shown in FIG. 3, the tracks 21 and 27 are enclosed within bellows 96, 97 and 98. These bellows serve to keep the tracks dust-free to ensure smooth operation.

OPERATION

In the illustrated apparatus, the article subjected to processing for subsequent quality control is a semi-circular wafer segment having one straight side. Such a semi-circular segment is prepared manually with the aid of a coarse manual indenter, which induces cleavage along a natural cleavage plane about 25 mm from the target feature. This operation, shown diagrammatically in FIG. 6*a*, produces a semi-circular wafer segment 101 used for further processing in the apparatus of FIGS. 1–5 according to the operations illustrated diagrammatically in FIGS. 6*b* and 6*c*.

Figure 7A:
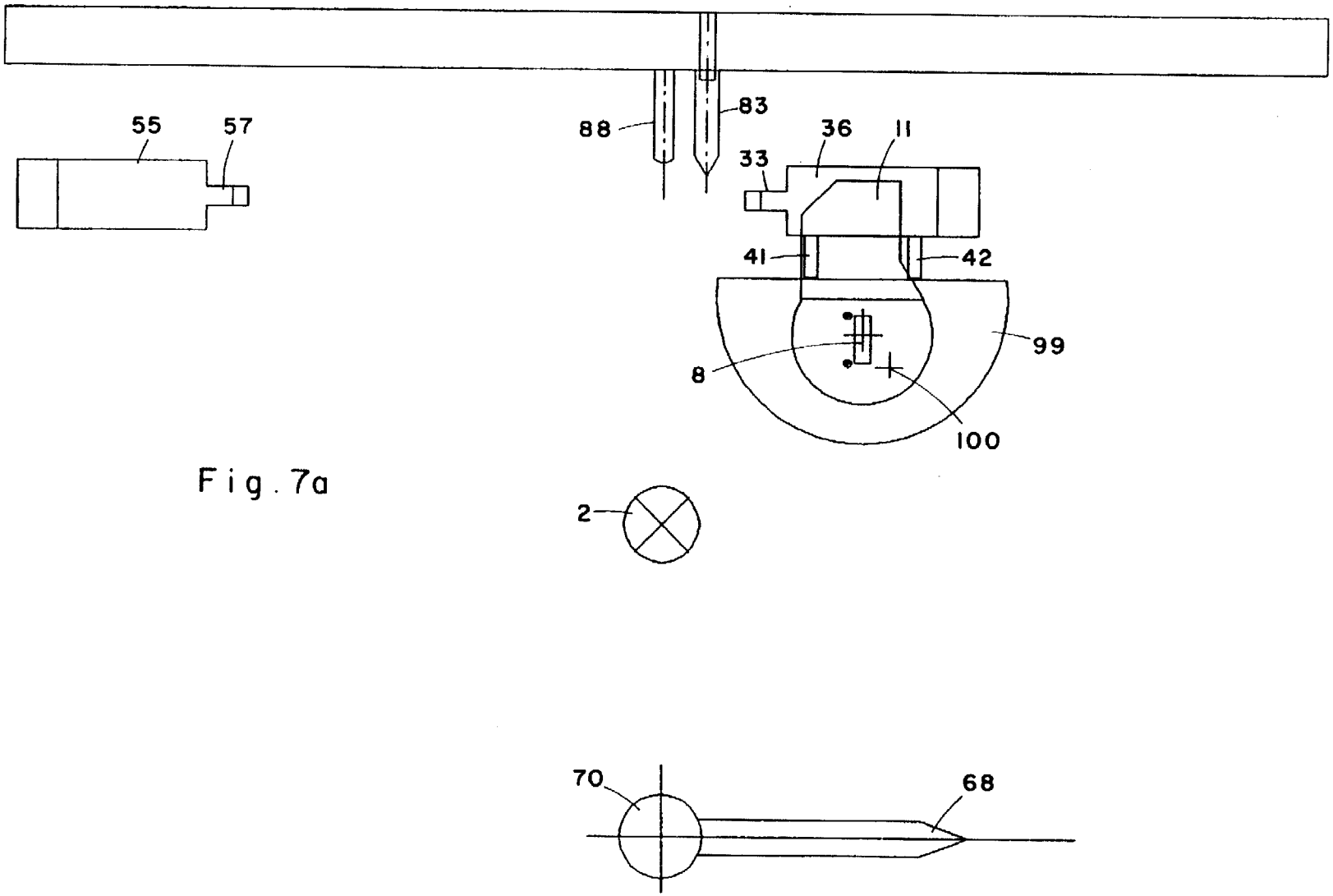
Figure 7B:
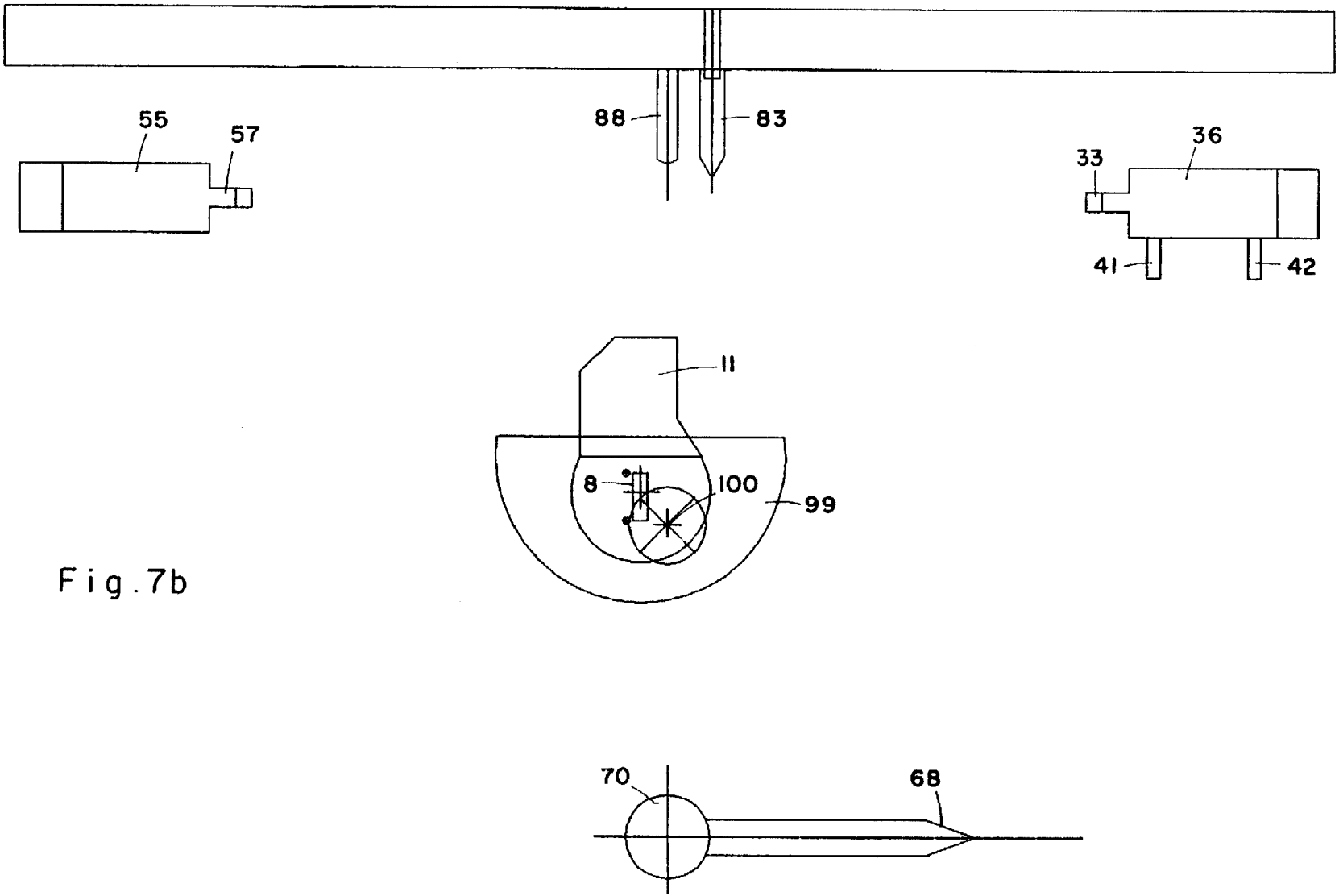

At the beginning of the processing, wafer segment 101 is placed on the vacuum chuck 8 and column 9, and is aligned by means of the alignment pins 41 and 42 of the first gripper assembly 32 (FIG. 7*a*). Once the wafer segment 101 is properly aligned, vacuum is applied to cause the segment to be firmly held by chuck 8. The vacuum chuck assembly 7 is then moved by keyboard-triggered computer commands in the X- and Y-directions to bring the target feature 100 underneath microscope 2. The microscope is adjusted manually by means of knob 5 in order to bring the wafer segment into focus. Once this is achieved, the target feature 100 is located through further fine adjustment of the position of the vacuum chuck assembly 7 by further keyboard-triggered computer commands actuating the step motors 23 and 29 that are responsible for the translatory movements of the vacuum chuck assembly 7 in the X- and Y-directions. When the target feature is brought precisely underneath the crosshair of microscope 2 as shown in FIG. 7*b*, the position is entered into the computer and serves as reference for all subsequent manipulations.

Figure 7C:
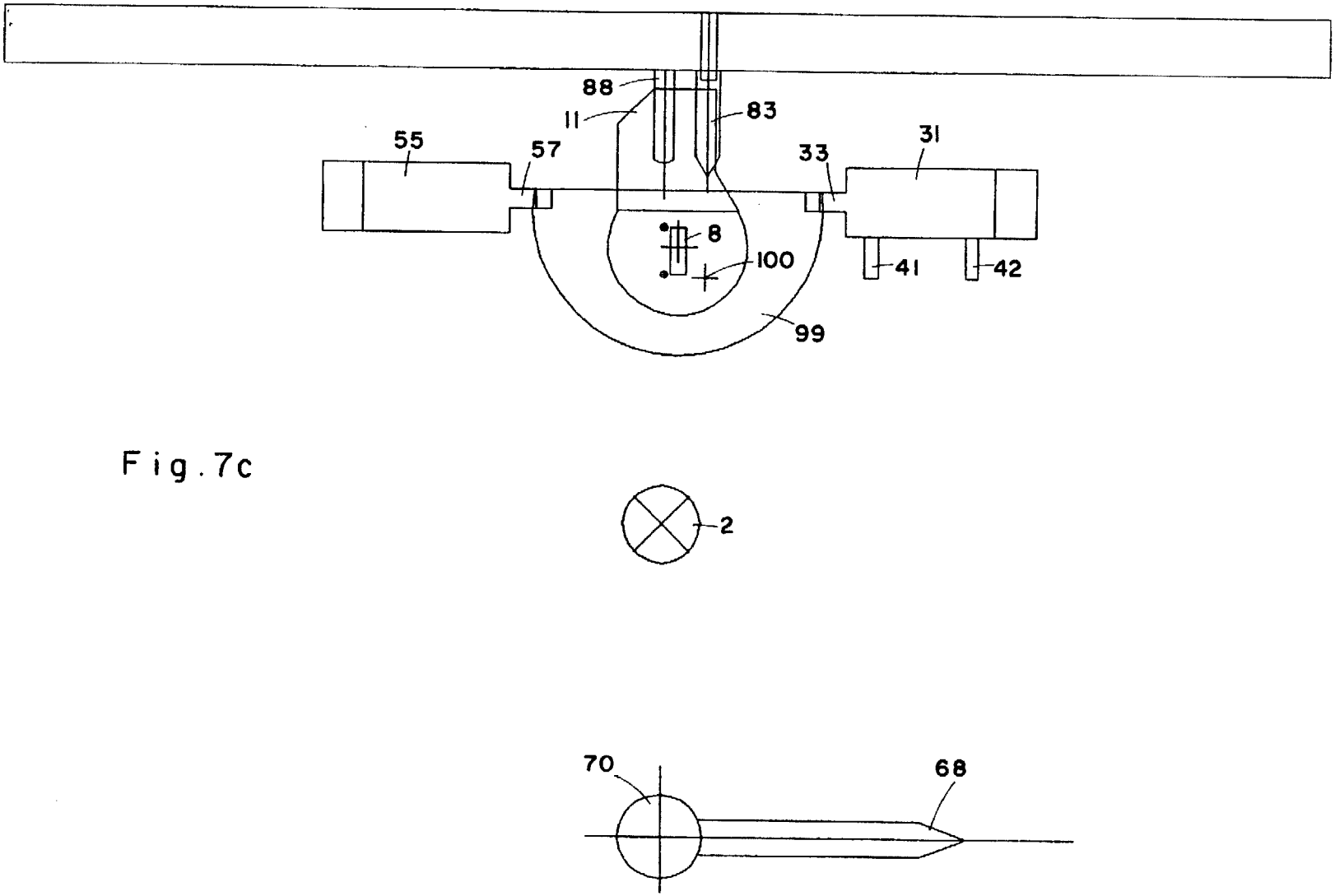

The first coarse cleavage operation is then performed to produce the first lateral face shown at 102*a* in FIG. 6*b*. For this purpose, the vacuum chuck assembly 7 is moved so that the straight side of the semi-circular wafer segment 101 is aligned with the rear sides of the upper jaws 33 and 37, and with the straight side of the semi-circular wafer segment 101 facing the coarse diamond indenter 82. The gripper assemblies 32 and 53 are now moved towards each other in the X-direction to close in on the wafer segment 101 located on chuck 8 and column 9. When the grippers have reached the position in which the jaws 33, 34 of the first gripper assembly 32, and jaws 57, 58 of the second gripper assembly 53, are ready to grip the wafer segment (which is indicated by a signal produced by sensors 35 and 59), the vacuum of chuck 8 is automatically released and the segment is gripped by the grippers, as shown in FIG. 7*c*. Motor 44 of gripper assembly 32 is now automatically activated to pull nut 46 backwards against the action of spring 48. This pulls back rear member 47, and with it block 36 and jaws 33 and 34, to stress the wafer segment by a force of 10–15 kg.

For actuation of the coarse diamond indenter 82, the vacuum chuck assembly 7 is moved in the Y-direction (i.e., widthwise of the apparatus) from left to right (with reference to FIG. 2) until extension 11 contacts the left hand side end of the second pushbar 86. Pushbar 86 is thus pushed to the rear and activates lever 85. This activates the first pushbar 83 which latter in turn pushes the coarse diamond indenter 82 to indent the straight side of the semi-circular wafer 101. This wafer is thereby cleaved along a natural cleavage plane to form lateral face 102*a* in FIG. 6*b*. The location of the indentation is so selected that the resulting cleavage plane is at a distance of about 0.5–1 mm from the target feature 100 (see FIGS. 7*c* and 7*d*).

The above first coarse cleavage operation produces a portion of segment 101 with the target feature 100 which is held by the second gripper assembly 53, and another portion of segment 101 which is discarded.

Figure 7D:
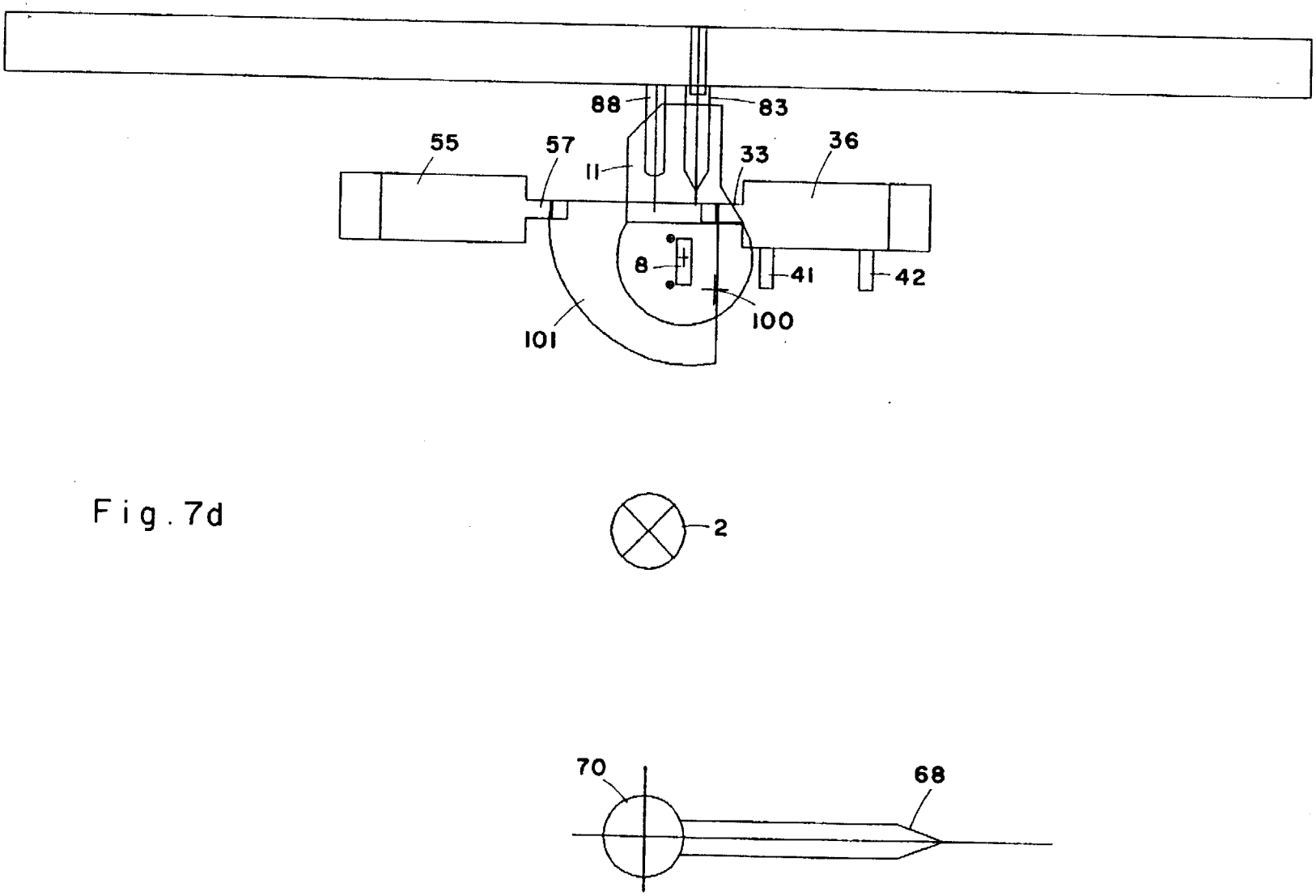
Figure 7E:
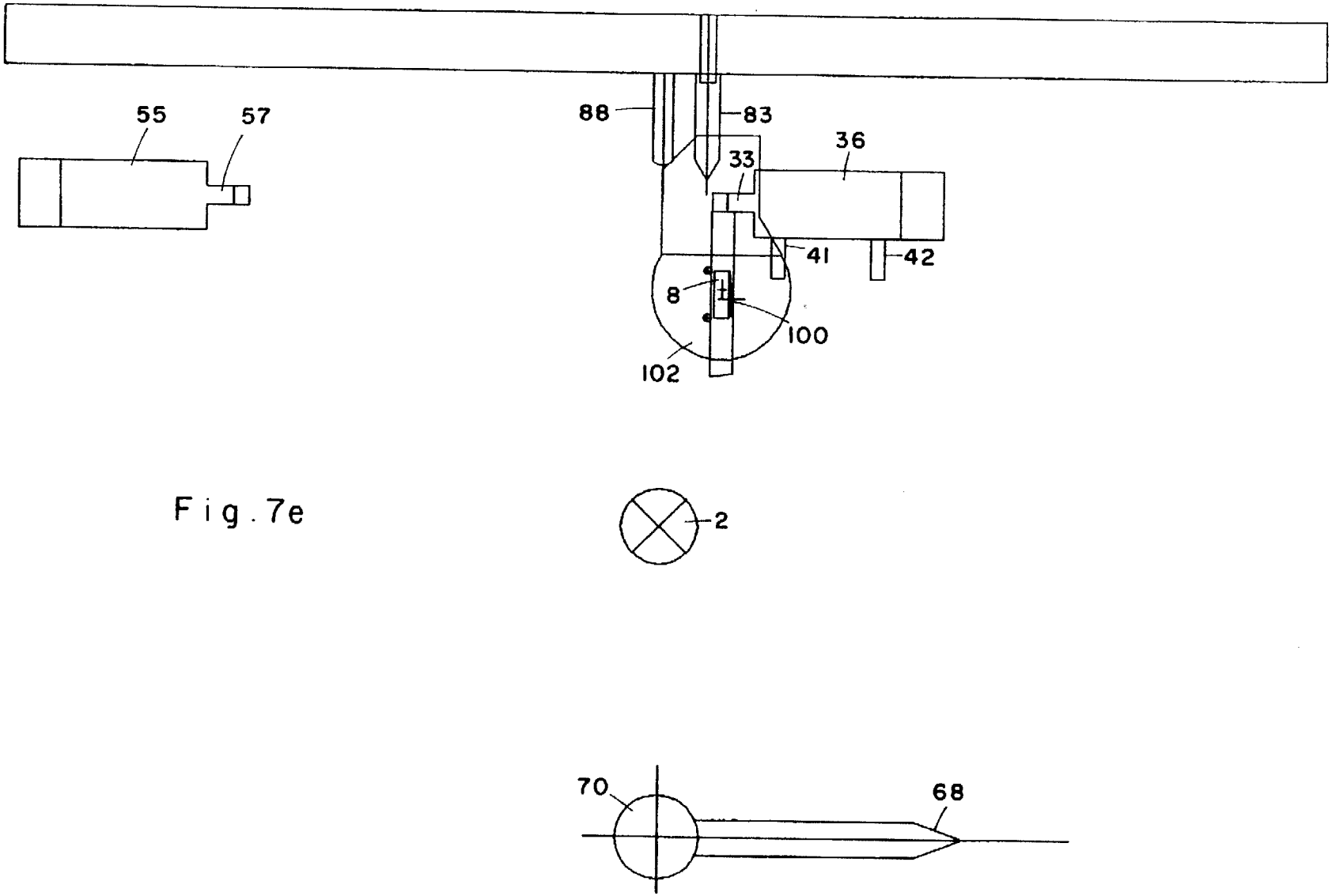

At this point, the second gripper assembly 53, which still grips the retained wafer segment 101, is advanced in the X-direction from left to right (with reference to FIG. 1) by about 10–15 mm whereupon the segment is also gripped by the second gripper assembly 53 as shown in FIG. 7*d*. The gripped portion of the segment is then subjected to a second coarse cleavage operation which is essentially similar to the first one, and which produces the second lateral face 102*b* in FIG. 6*b*. For proper alignment of the second gripper assembly 53 with the first gripper assembly 32, any upward inclination resulting from the previous opeation may be levelled out by means of the miniplunger 66 actuating bracket 65.

If desired, a slightly modified procedure may be applied for the second coarse cleavage. Such a modified procedure would include first activating the microplungers 39 and 40 so as to reciprocate the first gripper assembly 32, and then applying to the wafer segment a much smaller stress, say of about 1 kg only. It has been found that this modified procedure may be advantageous in certain situations where, because of the smaller size of the segment that is subjected to the second coarse cleavage, jaws 33, 34 of the first gripper assembly 32 come close to the area of the second coarse cleavage plane. If desired, the above modified procedure may also be applied to the first coarse cleavage.

At the end of the second coarse cleavage operation, there remains a strip-shaped wafer segment 102 (FIGS. 6*b*, 7*c*) which carries the target feature 100 between its two lateral faces 102*a*, 102*b*. This segment is now held by the first gripper assembly 32. A second wafer segment, which was held by the second gripper assembly, is discarded. The strip-shaped wafer segment 102 left with the first gripper assembly 32 is the object which is subsequently subjected to fine cleavage as illustrated in FIG. 6*c*, and to microscopic examination.

For fine cleavage, the strip-shaped wafer segment 102 is transported by the gripper assembly 32 back to the vacuum chuck assembly 7 whereupon vacuum is applied to chuck 8, the jaws 33, 34 are released, and gripper assembly 32 is withdrawn.

Preparatory to the fine cleavage, the vacuum chuck assembly 7 is first rotated clockwise by 90° so that the lateral face 102*a* (FIG. 6*c*) of the wafer segment that is closest to the target feature 100 faces the fine diamond indenter 68 when the latter is rotated to its operative position. The vacuum chuck assembly 7 is now moved to bring the target feature 100 underneath the crosshair of the microscope 2 for user activated realignment in the X-direction and centering of the designated point of contact of indenter 68. This realignment is followed by a withdrawal of the vacuum chuck from underneath microscope 2 in the Y-direction away from the fine diamond indenter 68. Arm 69 of the fine diamond indenter 68 is now rotated by knob 70 until bracket 72 engages stop 71. The tip of the fine diamond indenter 68 is brought underneath the crosshair of microscope 2 by fine adjustment of knobs 73, 74 and 75.

Figure 7F:
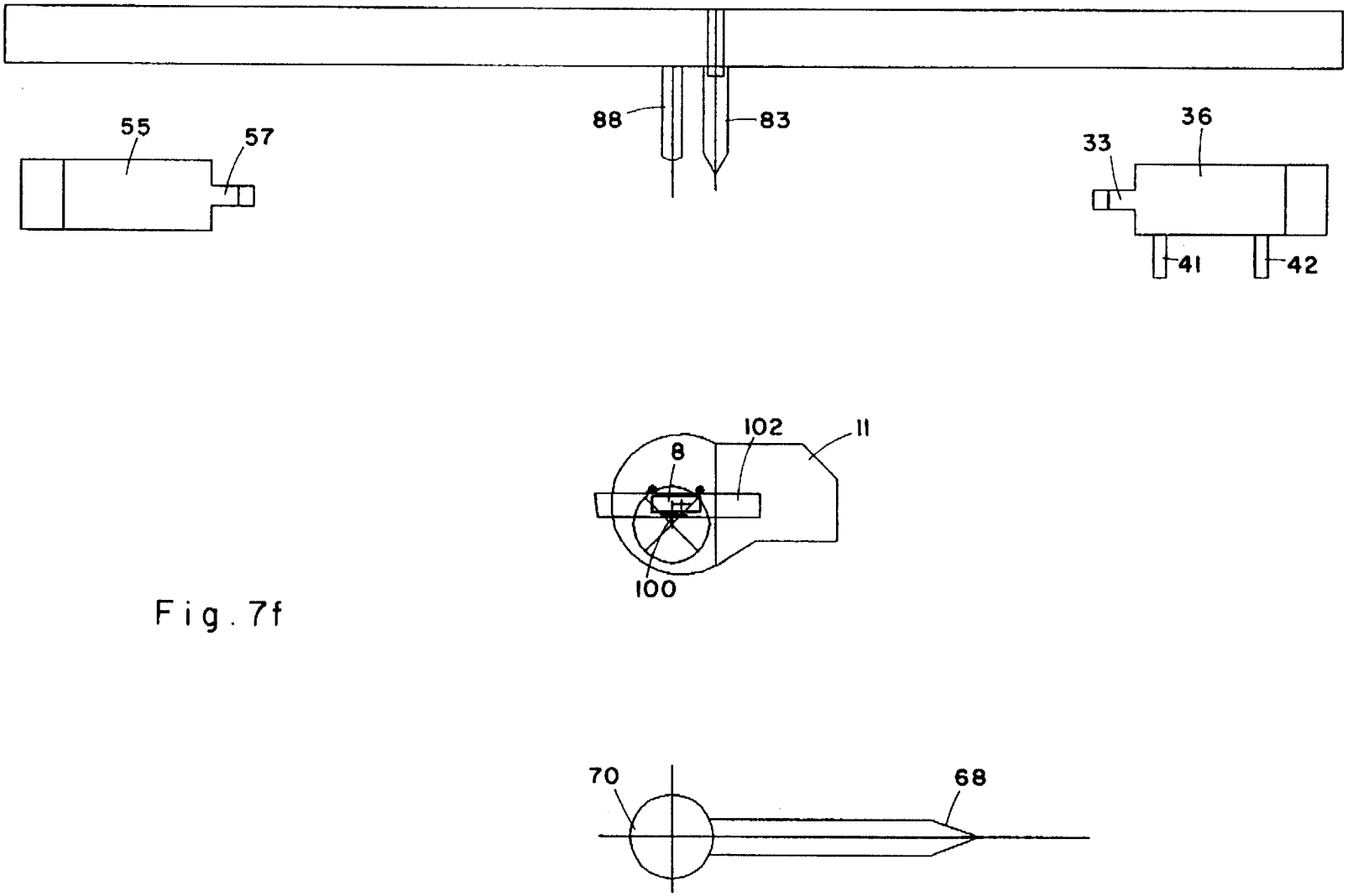
Figure 7G:
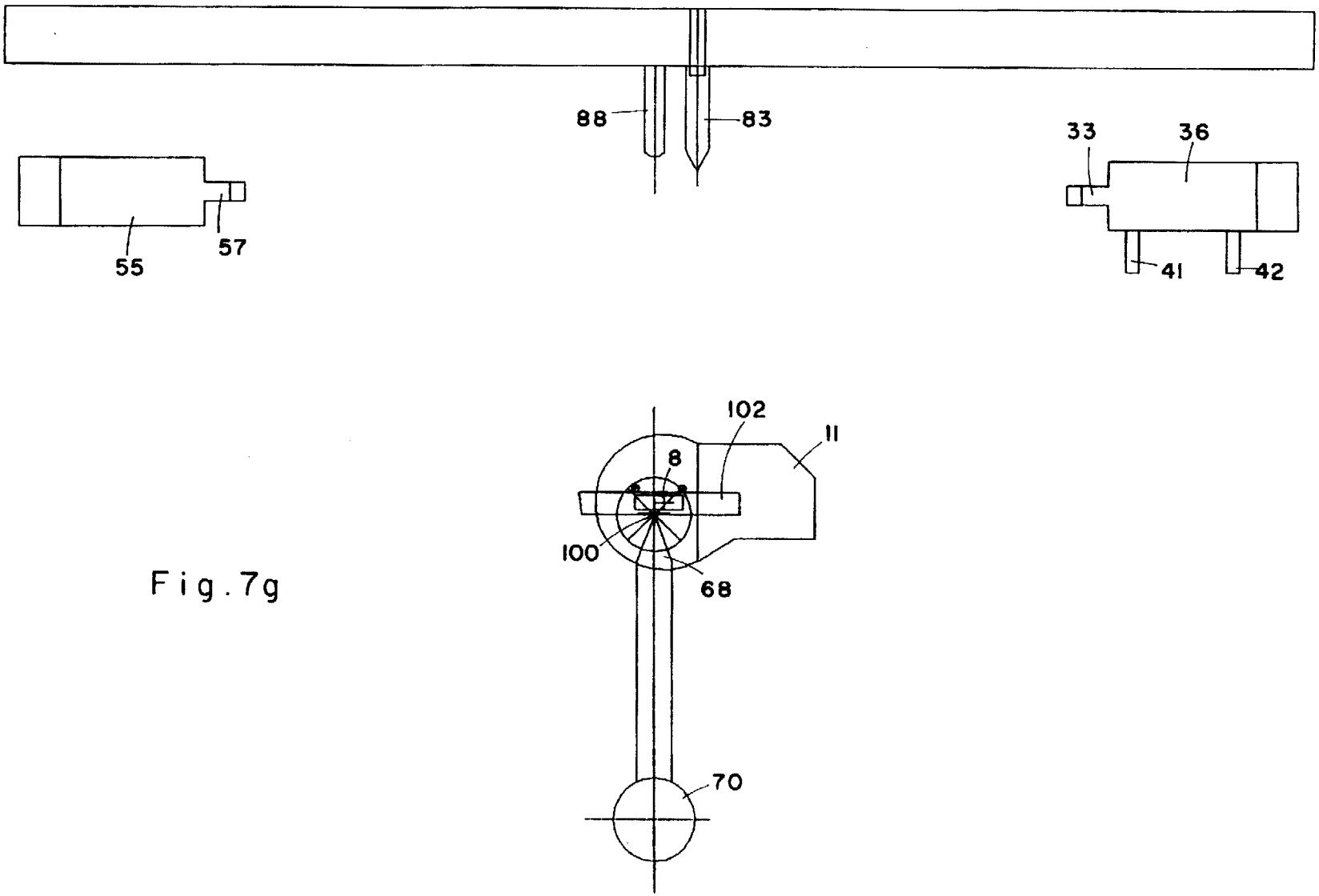

Vacuum chuck assembly 7 is now automatically moved back to its previous, aligned position of FIG. 7*f* whereby the tip of the fine diamond indenter 68 contacts the first lateral face 102*a* (FIG. 6*c*) of the strip-shaped wafer segment 102 opposite the target feature as shown in FIG. 7*g*. Upon such contact, the computer releases a suitable command by which the first lateral face of the wafer segment is scribed verically to produce scribe line SL (FIG. 8). The diamond tip follows the lateral face contour because of the closed loop depth control arrangement of which the load sensor 79 forms a part (see FIGS. 7*g* and 8).

Figure 7H:
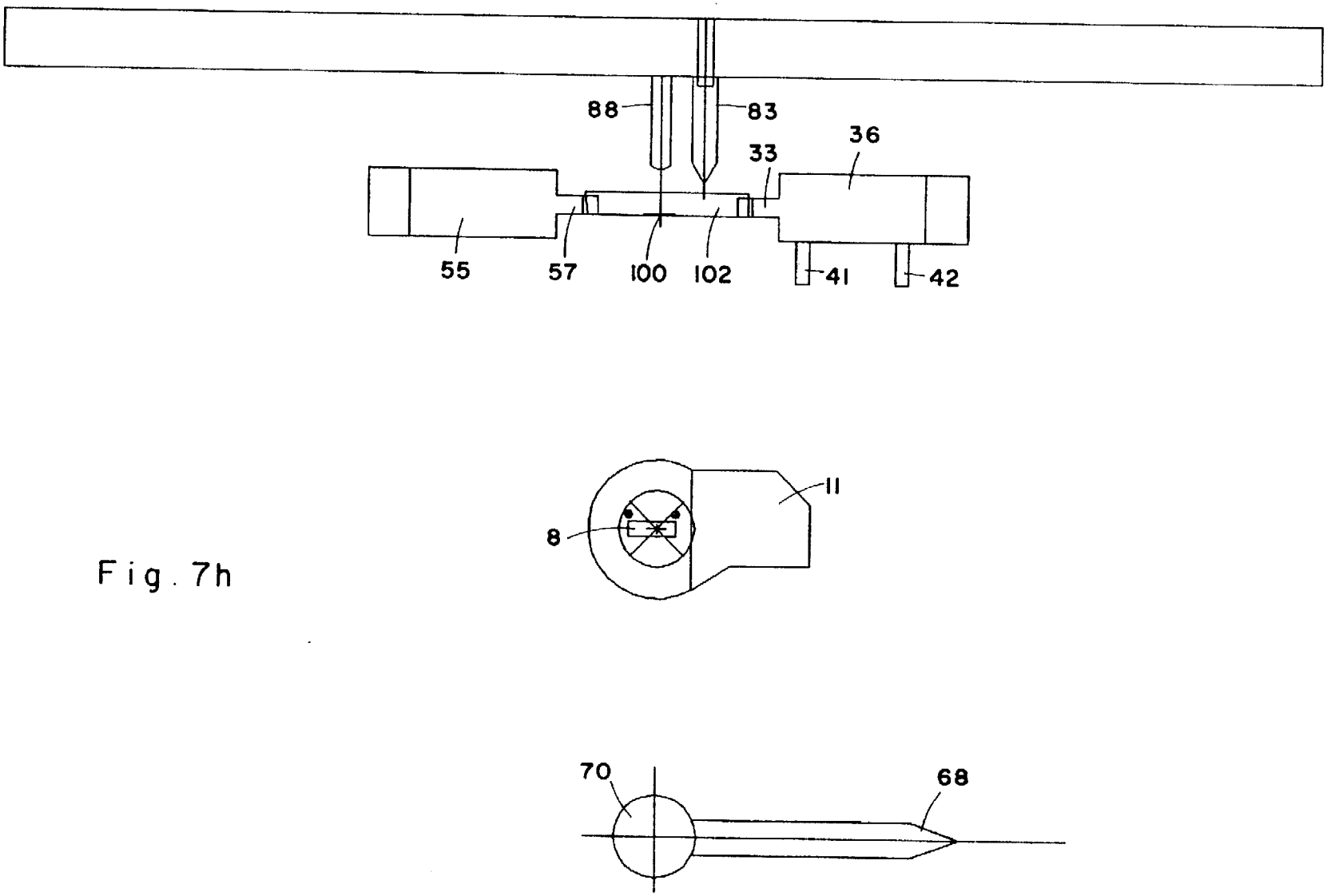
Figure 7I:
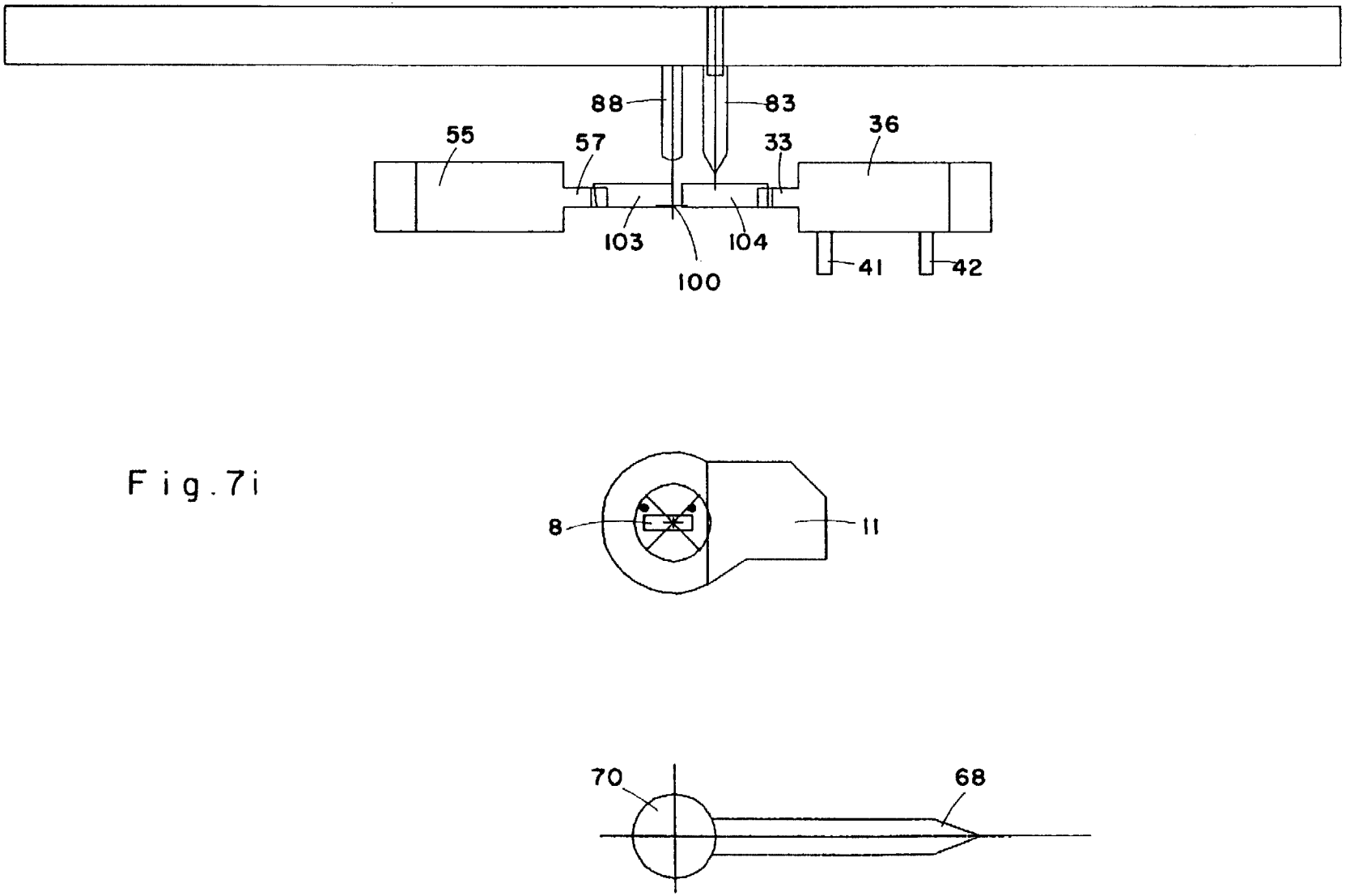

A linear correlation exists between a load and indentation depths which enables the feedback loop to control the depth of scribed line SL within a resolution of 1 micron. Thus, the load cells are zeroed and the diamond indenter tip 68 is advanced in the Y-direction at a microstepping rate, say of about 10 pulses per second, until the load cell 79 indicates that the pressure exceeds a specified limit. The scribing motor 78 is now operated to perform a Z-direction movement as shown in FIGS. 7*h* and 8. If, in the process of producing the scribed line SL the load sensed exceeds the predetermined upper limit, the fine diamond indenter 68 is retracted in the Y-direction until the load sensed falls within the tolerance limit. If, on the other hand, the sensed load drops below a lower limit, the fine diamond indenter 68 is further advanced in the Y-direction to further penetrate the wafer substrate until the load is restored to within the tolerance limit. The Z-direction movement which performs the vertical scribing of line SL continues until the fine diamond indenter 68 has been lowered below the wafer.

The scribed wafer segment is now transported into alignment with the gripper assemblies 32 and 53 by shifting vacuum chuck asembly 7 in the Y-direciton.

The grippers are again moved towards each other so as to close in on the vacuum chuck 8. The vacuum is then released, and the wafer segment 102 is gripped by the two pairs of jaws 33, 34 and 57, 58. A tension force of about 5–10 Kqm (approximately two-thirds of the tension applied in the coarse cleavage operations) is applied to the wafer, and the vacuum chuck assembly 7 is withdrawn. The hammer 88 is then caused to strike the second lateral face 102*b* (FIG. 6*c*) of the wafer segment 102. This produces the desired fine cleavage (see FIGS. 6*c*, 7*h*, 7*i* and 9) splitting the wafer into segments 103 and 104. Segment 104, which bears the target feature 100, is reloaded onto the vacuum chuck and is transported underneath microscope 2 for final inspection and verification. It may then be withdrawn for microscopic examination outside the apparatus, as known per se.

If desired, the wafer segment may be cooled during the cleavage operations, e.g., by indirect heat exchange with liquid nitrogen.

Where technical features mentioned in any claim are followed by reference signs, those reference signs have been included for the sole purpose of increasing the intelligibility of the claims and accordingly, such reference signs do not have any limiting effect on the scope of each element identified by way of example by such reference signs.

We claim:

1. A method of cleaving a relatively thin article for inspecting a target feature on a large-area workface thereof circumscribed by small-area lateral faces defining the thickness of the article, comprising the steps:

(a) producing an indentation in a first small-area lateral face of the article on one side of the target feature;

(b) and inducing, in a second, small area lateral face of the article, on an opposite side thereof with respect to the target feature, a shock wave in alignment with said target feature and said indentation on the first lateral face, to split the article along a cleavage plane coinciding with said target feature and said indentation.

2. The method according to claim 1, wherein said article is stressed in tension by gripping means gripping the article on opposite sides of said cleavage plane at the time said shock wave is induced.

3. The method according to claim 2, wherein said shock wave is produced by impacting said second lateral face of the article.

4. The method according to claim 3, wherein said article is a semiconductor wafer and wherein, before steps (a) and (b), a coarse cleaving operation is performed on a larger segment of the semiconductor wafer to produce a smaller segment of the semiconductor wafer containing said target feature; said steps (a) and (b) constituting a fine cleaving operation performed on said smaller segment of the semiconductor wafer to split it along said cleavage plane coinciding with said target feature.

5. The method according to claim 4, wherein said coarse cleaving operation is performed by applying an indentation to a lateral face of the larger segment of the semiconductor wafer on one side of the target feature, while stressing the larger segment of the semiconductor wafer in tension, such as to split the larger segment to define said smaller segment having said first lateral face on one side of the target feature.

6. The method according to claim 5, wherein said fine cleaving operation is performed on a smaller segment of the semiconductor wafer in which said first lateral face is produced by a first coarse cleaving operation, and said second lateral face is produced by a second coarse cleaving operation performed like the first coarse cleaving operation.

7. The method according to claim 4, wherein said indentation is produced by a scribing member moved along said first lateral face of the semiconductor wafer to scribe a line extending perpendicularly to said workface of the semiconductor wafer.

8. The method according to claim 7, wherein said scribing member is controlled so as to follow the contour of said first lateral face of the semiconductor wafer.

9. The method according to claim 7, wherein said scribing member is controlled so as to produce a scribe line of unform depth in said first lateral face of the semiconductor wafer.

10. The method according to claim 1, wherein the workface of the article has a length and width of many millimeters, and the thickness of said article at said first and second lateral faces thereof is a fraction of a millimeter.

* * * * *